United States Patent [19]

Ellis

[11] Patent Number: 4,893,425

[45] Date of Patent: Jan. 16, 1990

[54] PORTABLE LIGHTWEIGHT DISPLAY BOARD ASSEMBLY

[75] Inventor: Priscilla M. Ellis, Silver Lake, Ohio

[73] Assignee: The McNellis Company, New Brighton, Pa.

[21] Appl. No.: 240,528

[22] Filed: Sep. 6, 1988

[51] Int. Cl.[4] ..... G09F 7/06

[52] U.S. Cl. ..... 40/622

[58] Field of Search ..... 40/622, 1; 428/71, 76; 434/428, 430; 5/499, 490, 488; 248/497; D19/52

[56] References Cited

U.S. PATENT DOCUMENTS

| | | | |
|---|---|---|---|
| 1,712,829 | 5/1929 | Klimowicz | 40/622 |
| 2,845,637 | 8/1958 | Stefano | 5/490 |
| 4,005,539 | 2/1977 | Chamberlain | 40/622 |
| 4,721,644 | 1/1988 | Mayo | 211/87 |

*Primary Examiner*—Robert P. Swiatek
*Assistant Examiner*—Cary E. Stone
*Attorney, Agent, or Firm*—Oldham & Oldham Co.

[57] ABSTRACT

A portable display board assembly, comprising a rigid, foamed plastic (e.g., polystyrene) board covered with a closely fitting cloth or fabric cover, is disclosed. The board is of rectangular shape, having a thickness much less than either the width or height. The cover conforms to the board in shape, and has a pair of side panels which overlie the respective sides of the board, or edges which overlie the respective edges of the board, and an opening closed by a zipper, which permits insertion and removal of the board without bending. The cover is also provided with at least two (and sometimes three) pairs of aligned openings for bolts which are used to hang the board assembly on a vertical wall. These bolts coact with a bracket affixed to the wall.

10 Claims, 2 Drawing Sheets

PORTABLE LIGHTWEIGHT DISPLAY BOARD ASSEMBLY

TECHNICAL FIELD

This invention related to display boards, such as bulletin boards or the like, on which notices, stories, posters or other writings and the like, may be displayed.

BACKGROUND ART

Display boards are widely used for displaying various lightweight objects and printed matter, such as notices, posters, stories, and the like. These are commonly known as bulletin boards because of the widespread use of such boards for bulletins or notices. However, boards of similar structure and material can be used to display other writings (e.g., stories and posters) consisting of written or printed matter on a paper cardboard sheet, and even other relatively flat, lightweight objects, and so the more generic term, "display board", will be used herein. Typically the object to be displayed (usually a paper sheet with desired written or printed matter thereon) will be affixed to the board by means of pins, thumb tacks, or other lightweight fastener comprising a head and a stiff wire ending in a sharp point.

Display boards are made of materials, usually relatively rigid and light in weight, which are capable of receiving thumb tacks, pins, etc. firmly, and also capable of relaxing or substantially recovering their original shape without leaving pin or thumbtack marks, when the pin or thumbtack is removed. Cork is widely used as a bulletin board material because it possesses these qualities and in addition has a pleasing appearance. Other display board materials are also known. However, a major disadvantage of cork and other display board materials now in use is that they are quite costly. Adding to the cost of a cork bulletin board is that it must be framed or edge-bound, e.g. with wood framing, in order to prevent crumbling at the edges. This adds materially to the cost. In addition, most display board materials, including cork, are better suited to display boards which are permanently mounted in one place rather than being capable of being taken from place to place.

DISCLOSURE OF THE INVENTION

An object of this invention is to provide an aesthetically pleasing lightweight portable display board.

This and other objects are achieved by means of a novel portable covered bulletin board assembly comprising:

(a) an essentially rigid rectangular board capable of receiving pins or the like, said board having a thickness substantially less than its width or height;

(b) a removable flexible cloth cover adapted to enclose said board and to fit closely thereover, said cover being of generally rectangular shape conforming to that of said board and including a pair of side panels and four edges corresponding, respectively, to the two sides and four edges of the board, said cover having an opening sufficiently large to permit removal of said board without bending, fastener means for closing said opening, and at least two pairs of aligned holes in the side panels to receive a pair of fastener members for securing said board assembly to a vertical wall.

This invention according to another aspect provides a cloth cover as above described.

This invention according to still another aspect provides a wall mounted assembly comprising a display board assembly as above, a pair of bolts extending through the board and two pairs of aligned holes in the cover, and wall mounted bracket means for receiving the bolts.

BEST MODE FOR CARRYING OUT THE INVENTION

The best mode and preferred embodiment of this invention will now be described with reference to the accompanying drawings.

Figure 1:
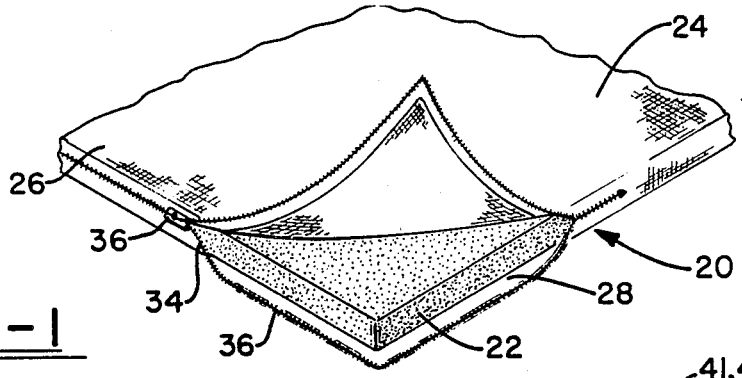
FIG. 1 is a perspective view, with parts broken away, of a display board assembly according to this invention, with one corner of the cover turned back to show the board.

Referring to FIG. 1, the portable lightweight display board assembly 20 of this invention comprises an essentially rigid, rectangular board 22 and a close-fitting, removeable soft or fabric cover 24. A corner of cover 24 has been turned back in FIG. 1 to show the board 22. Normally, cover 24 completely encloses board 22.

Board 22 is in the shape of a rectangular prism having a thickness substantially less than either the width or height thereof. The width and height may be either equal (in which case the board is square in shape) or unequal; the latter has been chosen for illustration herein. While board 22 may be made of any conventional bulletin board material, such as cork, fiberboard, acoustic tile or the like, a board of rigid foamed plastic, such as rigid polyurethane or rigid, foamed polystyrene ("Styrofoam"), especially the latter, is preferred for reasons of low cost, lightweight, and portability. Insulation grade extruder polystyrene is particularly suitable. The board may be of any desired size; boards $4' \times 4' \times 1''$ or $24'' \times 30'' \times 1''$ are particularly suitable. The board may be purchased in the desired size or may be cut to size by the user.

The cover may be made of any cloth or fabric which is durable, flexible, and readily fashioned into a cover of desired configuration (to be described hereinafter in detail) which will fit closely over the board 22. The preferred cover material is a felted 100% polyester upholstery fabric available from Milliken Mills.

Figure 2:
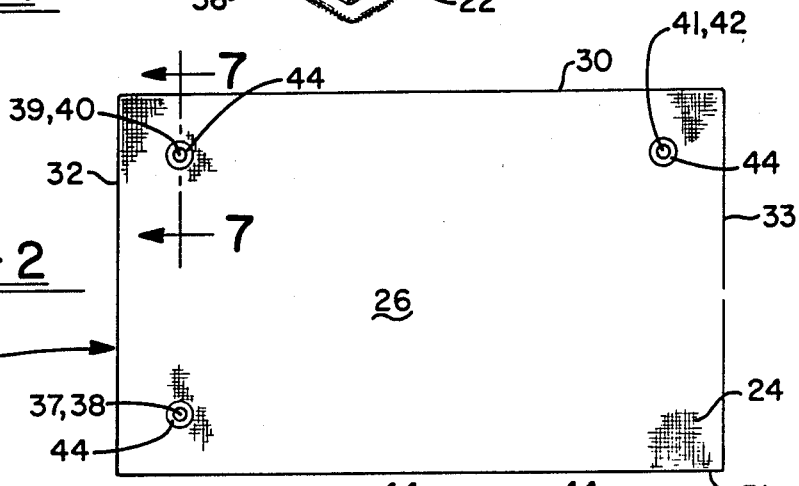
FIG. 2 is a front elevational view of a display board assembly of this invention, as it will appear when hung horizontally (i.e., so that the two longer sides are horizontal).
Figure 4:
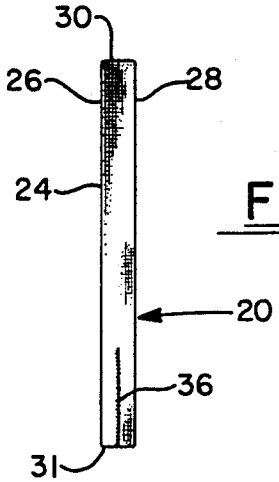
FIG. 4 is a side elevational view of a display board assembly of this invention.
Figure 3:
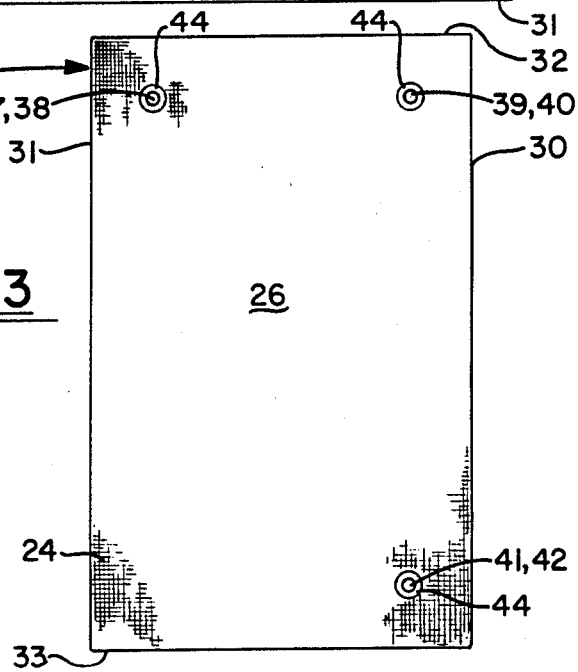
FIG. 3 is a front elevational view of a display board assembly of this invention, hung vertically.
Figure 5:
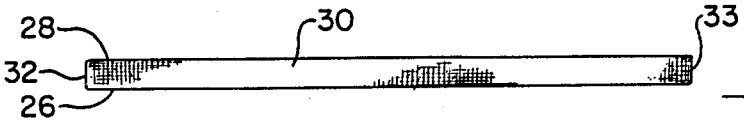
FIG. 5 is a top view of a display board assembly of this invention.
Figure 6:
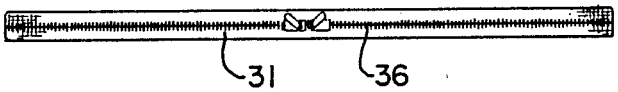
FIG. 6 is a bottom view of a display board assembly of this invention.

The structure of cover 24 will now be shown with particular reference to FIGS. 2, 3 and 4. Referring to these Figures, cover 24 is essentially a hollow, rectangular prism in shape, just slightly larger than the board 22 which it encloses (being just slightly larger so as to give a close fit while permitting the board to be inserted and removed), and comprising a pair of spaced, flexible rectangular side panels 26 and 28, which overlie the respective sides of board 22, and further comprising top, bottoom, left hand and right hand edges 30, 31, 32, and 33, respectively. The four edges of the cover respectively overlie the four edges of the board 22. Side panels 26 and 28 become the front and back panels, respectively, of the display board assembly 20 when it is secured to a vertical wall. Objects to be displayed are affixed to the front panel 26 and the board beneath the front panel. Side panels 26 and 28 are just slightly larger than the sides of board 22 in height and width. Similarly, the dimensions of edges 30, 31, 32 and 33 of the cover are just slightly greater than the dimensions of the corresponding edges of board 22. An opening or slit 34 is provided along the bottom edge 31 and along the lower portions of the side edges 32, 33 so tha the board 22 can be inserted into and removed from cover 24 without bending. Opening 34 is closeable by conventional fasteners means, preferably a zipper or slide fastener 36. The zipper 36 is of conventional structure comprising two rows of intermeshing teeth and a pull for opening and closing the zipper.

Side panels 26 and 28 have bolt holes 37, 38, 39, 40, 41 and 42 (the odd numbered holes being in panel 26, the even numbered holes being in panel 28), to receive a pair of bolts (to be described hereinafter) for securing the display board assembly 20 to a vertical wall. These holes arranged in aligned pairs 37, 38; 39, 40; and 41, 42. The bolt holes are equidistant from the adjacent edges; in a 24"×30"×1" board assembly, the bolt holes may be 3 inches from each of the adjacent edges. The bolt holes are arranged in an L-shaped pattern as shown in FIGS. 2 and 3. Provision of three pairs of bolt holes permits the assembly 20 to be hung either horizontally (the longer edges, 30, 31 being horizontal) as shown in FIG. 2, or vertically as shown in FIG. 3. When the display board assembly is square, one pair of bolt holes (i.e., 37, 38) may be omitted. Each of the bolt holes is surrounded by an eyelet or grommet 44 to prevent fraying.

Cover 24 may be formed from a single piece of rectangular cloth as will be apparent to those familiar with sewing. The cloth is folded once (the fold becomes top edge 30) and sewn along the sides, with an opening 34 left along the bottom edge 31, the lower portions of the side edges being 32, 33. A zipper 36 is sewn in to provide a closure for this opening.

Figure 7:
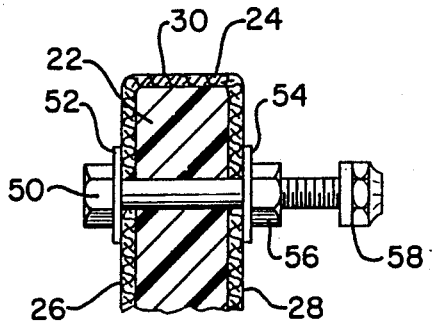
FIG. 7 is vertical sectional view, taken along lines 7—7 of FIG. 1, showing a portion of a display board assembly of this invention, together with a bolt used to secure the assembly to a vertical wall.
Figure 8:
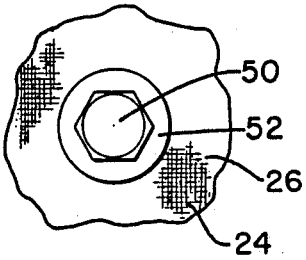
FIG. 8 is a front view, on an enlarged scale, of a portion of the display board assembly of this invention and the head of the bolt shown in FIG. 7.
Figure 9:
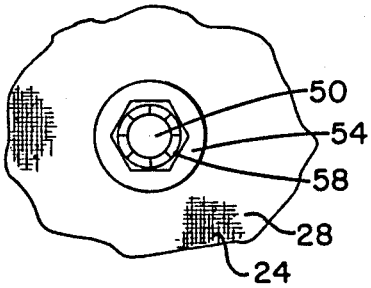
FIG. 9 is a back view, on an enlarged scale, of a portion of a display board assembly of this invention, showing the shank end of the bolt shown in FIG. 7.

Display board assembly 20 may be secured to a vertical wall as will be described hereinafter with reference to FIGS. 7–11. Assuming that the assembly 20 is to be hung horizontally, as shown in FIG. 2, a pair of bolts 50 (see especially FIG. 7 and 10) are passed through aligned holes 39, 40 and 41, 42. Passage of bolts 50 through aligned holes 39, 40 and 41,42 in the cover forms holes in the board 22 which are respectively aligned with the pairs of holes in the cover. (Holes may be preformed in the board, but this is usually not preferred because of the softness of the preferred board materials). Conventional machine bolts, each having a flat head and a shank with a smooth upper portion (the portion closest to the head) and a screw-threaded lower portion (the portion remote from the head), as best seen in FIG. 7, are preferred. The bolt assembly also includes a pair of flat washers 52, 54, a hex nut 56, and a lock nut 58, the latter being placed at the end of the shank. As assembled (see FIG. 7), the bolt head and the first flat washer 52 engage front panel 26 of cover 24. The second flat washer 54 engages the back panel 28 of cover 24. Hex nut 56 is then tightened against washer 54. Bolts 2 inches in length are preferred when board 22 is one inch thick. This leaves a small space between hex nut 56 and lock nut 58.

Figure 10:
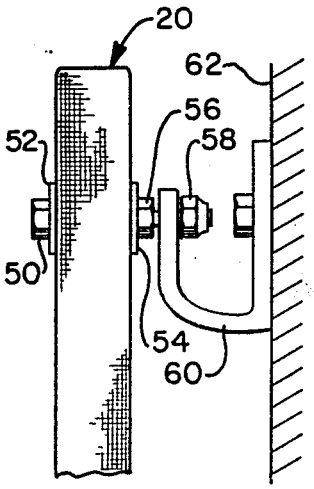
FIG. 10 is a side view of a display board assembly of this invention, with parts broken away, together with a bolt and wall-notched bracket for securing the display board assembly to a vertical wall.
Figure 11:
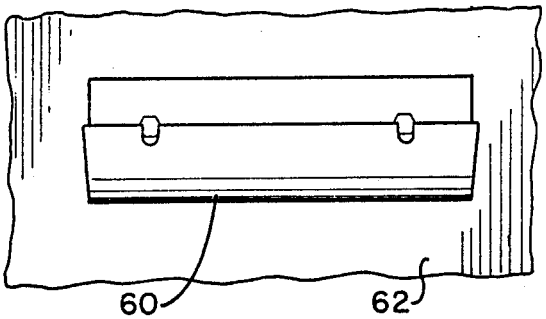
FIG. 11 is a front elevational view of the bracket and the adjacent portion of the wall to which it is affixed.

Bolts 50 engage a wall-mounted bracket 60, which may be permanently mounted on a vertical wall 62 by conventional means such as the plurality of bolts, as shown in FIG. 10. This bracket 60 is generally J-shaped, comprising a flat portion which lies against wall 62, and a curved portion or lip, the end of which recedes bolts 50 between hex nut 56 and lock nut 58. Since there is only a small clearance between these two nuts, the display board assembly 20 is securely mounted to the wall 62, with little or no wobbling. The bracket 60 may be similar in shape to a conventional binder or floor covering, such as vinyl floor covering or a carpet (such binders are typically used along the edge of the floor covering at doorways). FIG. 10 shows an edge view, and FIG. 11 a front view, of this bracket 60. Of course, the bracket 60 as shown herein is merely illustrative; other suitable bracket means, as for example, a pair of brackets, one for each bolt 50, may be used instead. Where it is desired not to affix bracket 60 permanently to a wall 62, a flat surface of bracket 60 may be provided with suction cups.

Display board assembly 20 may be mounted on an easel rather than on a wall if desired. Bolt holes 37–42 inclusive in cover 24 are not necessary for easel mounting. However, cover 24 as shown (including bolt holes 37–42 inclusive) is preferred because such a cover gives the user flexibility so that he (or she) can use either a wall mounting (as shown and described herein) or an easel mounting.

Board 22 may be preformed with bolt holes aligned with the bolt holes of the cover; however, this is not necesary, particularly when foamed polystyrene, which is comparatively soft, is used as the board material. Instead, the user forms bolt holes in the board at the time of first installation, simply by driving a pair of bolts 50 through the board 22.

The present invention provides an inexpensive, portable, aesthetically pleasing display board assembly which is both cheaper, lighter in weight and more readily portable than conventional display boards using cork or other conventional bulletin board material.

While this invention has been described with reference to a preferred embodiment thereof, this embodiment is by way of illustration and not limitation.

What is claimed is:

1. A portable display board assembly comprising:

(a) an essentially rigid rectangular board capable of receiving pins or the like, said board having a thickness substantially less than its width or height;

(b) a removable flexible cloth cover adapted to enclose said board and to fit closely thereover, said cover being of generally rectangular shape conforming to that of said board and including a pair of side panels and four edges corresponding, respectively, to the two sides and four edges of the board, said cover having an opening sufficiently large to permit removal of said board without bending, and fastener means for closing said opening.

2. A display board assembly as claimed in claim 1, wherein said cover also has at least two pairs of aligned holes in the side panels to receive a pair of fastener members for securing said board assembly to a vertical wall.

3. A display board assembly as claimed in claim 2 wherein said fastener members are bolts.

4. A display board as claimed in claim 2 in which said board has at least two holes which are aligned respectively with said at least two pairs of aligned holes in the cover.

5. A display board assembly as claimed in claim 1 wherein said rigid board is made of a rigid foamed plastic.

6. A display board assembly as claimed in claim 5 wherein said plastic is polystyrene.

7. A display board assembly as claimed in claim 1 wherein said cloth is 100% polyester upholstery fabric.

8. A wall mounted display board assembly comprising:

(a) a display board assembly as claimed in claim 1;

(b) a pair of bolts extending through said rigid board and through two pairs of said aligned holes in said cover; and (c) wall mounted bracket means for receiving said bolts.

9. A wall mounted assembly as claimed in claim 8 wherein said bracket means is a longitudinally extending strip of generally J-shaped cross section comprising a flat portion adapted to be placed against a vertical wall and a curved portion adapted to engage said bolts.

10. A wall mounted assembly as claimed in claim 9 wherein each of said bolts has associated therewith a pair of flat washers adapted to engage opposite sides of said display board and cover, a variably positionable hex nut, and a lock nut at the end of the bolt, said hex nut being spaced from said lock nut, the outer edge of the curved portion of said bracket means being received in the space between the hex nut and the lock nut of each bolt.

* * * * *